US005940045A

United States Patent [19]

Belcher et al.

[11] Patent Number: 5,940,045

[45] Date of Patent: Aug. 17, 1999

[54] OPTIMIZATION OF DC POWER TO EFFECTIVE IRRADIATED POWER CONVERSION EFFICIENCY FOR HELICAL ANTENNA

[75] Inventors: Donald K. Belcher, Rogersville, Tenn.; William D. Killen, Satellite Beach, Fla.

[73] Assignee: Harris Corporation, Melbourne, Fla.

[21] Appl. No.: 08/777,027

[22] Filed: Dec. 30, 1996

[51] Int. Cl.[6] ..... H01Q 1/50; H01Q 1/36

[52] U.S. Cl. ..... 343/850; 343/895; 343/853

[58] Field of Search ..... 343/852, 855, 343/853, 778, 895, 850

[56] References Cited

U.S. PATENT DOCUMENTS

| | | | |
|---|---|---|---|
| 3,983,561 | 9/1976 | Biagi et al. | 343/787 |
| 4,014,028 | 3/1977 | Cone et al. | 343/895 |
| 5,532,706 | 7/1996 | Reinhardt et al. | 343/853 |
| 5,568,158 | 10/1996 | Gould | 343/853 |

FOREIGN PATENT DOCUMENTS

| | | | |
|---|---|---|---|
| 573427 | 4/1959 | Canada | 343/895 |

*Primary Examiner*—Don Wong
*Assistant Examiner*—Tan Ho
*Attorney, Agent, or Firm*—Charles E. Wands

[57] ABSTRACT

A (monofilar or bifilar) helical antenna feed arrangement optimizes the efficiency of converting DC power of RF power amplifier circuitry into radiated power by means of a multi RF amplifier and port feed arrangement, that is exclusive of a lossy hybrid combiner. The arrangement combines the power conversion efficiencies of each of a plurality of RF amplifiers in an effectively lossless manner, and feeds the outputs of such RF power amplifiers, to respectively spaced apart, impedance matched, near end field feed locations of the helical antenna. A signal divider and associated phase delay circuit are operative to output respective phase-offset versions of a signal to be radiated by the helical antenna, which are offset in phase with respect to one another by the electrical phase differential between the spaced apart feed locations of the helical antenna.

17 Claims, 1 Drawing Sheet

OPTIMIZATION OF DC POWER TO EFFECTIVE IRRADIATED POWER CONVERSION EFFICIENCY FOR HELICAL ANTENNA

FIELD OF THE INVENTION

The present invention relates in general to communication systems, and is particularly directed to a new and improved scheme for optimizing the efficiency of converting DC power of RF power amplifier circuitry into radiated power of a helical antenna structure driven by the RF power amplifier.

BACKGROUND OF THE INVENTION

Communication systems that are subject to space and weight limitations, such as mobile, manually deployable configurations, often employ (monofilar or bifilar) helical antennas, such as diagrammatically illustrated at 10 in FIG. 1. In order to optimize performance (produce as much gain as possible for a given deployed volume), it is desired that the DC power to radiated RF power efficiency of the radiating system be as high as possible. While this could be accomplished by the use of complex RF power amplifier circuits, the cost of such components is prohibitively expensive. As a consequence, it has been customary practice to use relatively low cost (reduced complexity) RF power amplifiers in the antenna signal feed path. Because such low cost RF amplifier components are also generally low efficiency (e.g., on the order of only fifteen percent) devices, multiple amplifiers are normally operated in parallel, and then summed to provide a combination of their individual amplifying powers.

For this purpose, as diagrammatically shown in FIG. 1, an RF input signal of interest is coupled to a signal splitter 11, which outputs a pair of RF signals to respective (low efficiency) RF amplifiers 12 and 13. The amplified RF signals produced by the RF amplifiers are then recombined or summed in a combiner 14, the output of which is coupled to a single feed port 15 of the helical antenna 10. Unfortunately, because the effect of the combiner 14 is substantial insertion loss, (including that of a signal hybrid, printed circuit board propagation, cabling, etc.) the effective irradiated power of resultant signal applied to the feed port 15 of the helical antenna is substantially below (on the order of one-half to one dB) that produced by the combined effect of the respective RF amplifiers 12 and 13, which degrades the overall power DC power to irradiated power conversion efficiency of the antenna and its RF amplifier feed network.

SUMMARY OF THE INVENTION

In accordance with the present invention, the above-described efficiency limitations associated with feeding a single port of a limited space deployable helical antenna with a lossy circuit configuration containing low cost, low efficiency RF power amplifiers are effectively obviated by a new and improved multi RF amplifier feed arrangement, which combines or sums the power conversion efficiencies of each of a plurality of RF amplifiers in an effectively lossless manner, and feeds the outputs of such RF power amplifiers, exclusive of a lossy hybrid combiner, to respectively spaced apart, impedance matched, near end field feed locations of the helical antenna.

For this purpose, in a first 'monofilar' embodiment of the invention, spaced apart, impedance-matched signal feed locations of a monofilar helical antenna winding are coupled to outputs of a pair of relatively low efficiency RF power amplifiers. The RF amplifiers are respectively driven by phase offset versions of an input signal to be radiated. To derive the amplified RF signals for spaced apart antenna feed ports, the RF input signal is coupled to a signal divider, that contains a splitter and a phase delay circuit. The signal divider is operative to produce mutually phase offset versions of the RF input signal, which are coupled to respective ones of the RF amplifiers. The phase differential between the signals at the signal divider output ports is equal to the electrical phase differential between the spaced apart feed locations of monofilar helical antenna at the RF frequency of interest.

In a second, coaxial 'bifilar' helical winding antenna embodiment, the outputs of the pair of RF power amplifiers are respectively coupled to respective antenna feed locations of the coaxial antenna windings that provide maximum signal coupling between respective input signals supplied thereto, with the physical separation between feed locations having an electrical phase differential equal to the differential phase offset provided by the signal divider.

DETAILED DESCRIPTION

As pointed out briefly above, the multi RF amplifier feed arrangement of the present invention feeds the outputs of a plurality of low efficiency, low cost RF power amplifiers, to which respective phase offset versions of a signal of interest are supplied, directly to respectively spaced apart, impedance matched, near end field feed locations of a helical antenna (monofilar or bifilar), so as to sum the power conversion efficiencies of each of the RF amplifiers in an effectively lossless manner.

Figure 2:
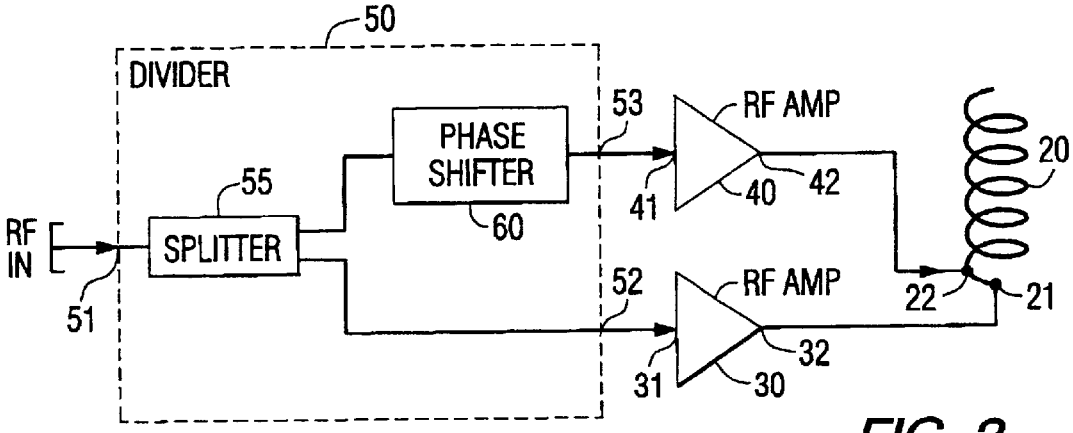
FIG. 2 diagrammatically illustrates a monofilar helical antenna having spaced apart feed locations coupled to a pair of RF power amplifiers, respectively driven by phase offset versions of an input signal to be radiated by the antenna.

For this purpose, in accordance with a first embodiment of the invention diagrammatically illustrated in FIG. 2, spaced apart feed locations 21 and 22 of a monofilar helical antenna 20 are coupled to outputs 32 and 42 of a pair of relatively low efficiency (and therefore relatively inexpensive) RF power amplifiers 30 and 40, respectively driven by phase offset versions of an input signal to be radiated. (For purposes of providing a non-limiting example, each of amplifiers 30 and 40 may have an efficiency on the order of only fifteen percent, so that to obtain a benefit from their use, plural ones of such components must be interconnected into a composite circuit, that will have the effect of combining their individual efficiencies to a more practical value, for example, a value on the order of 25–30%). The antenna feed locations 21 and 22 are points on the antenna 20 that provide maximum signal coupling between respective input signals supplied thereto from an upstream driving signal source. Associated with the physical separation between feed ports/locations 21 and 22 is an electrical phase differential defined in accordance with the RF frequency of the driving signal.

To derive the amplified RF signals for antenna input or feed ports 21 and 22, an RF input signal of interest is coupled to an input 51 of a signal divider 50 (comprised of a splitter 55 and phase delay circuit 60), which is operative to supply, at respective first and second output ports 52 and 53, mutually phase offset versions of the RF input signal. The first output port 52 of the signal divider 50 is coupled to an input 31 of the first RF power amplifier 30, while the second output port 53 of signal divider circuit 50 couples a phase offset version of the input signal to an input 41 of the second Rf power amplifier 40. The phase differential between the signals at divider output ports 52 and 53 may be derived by a phase delay circuit 60 coupled between input port 51 and output port 53, and is equal to the electrical phase differential between the spaced apart feed locations 21 and 22 of monofilar helical antenna 20 at the RF frequency of interest.

Thus, in the dual RF power feed helical antenna architecture of FIG. 2, the use of a pair of RF amplifiers 30 and 40 to feed respectively amplified and phase offset versions of the input signal to impedance-matched, near end field feed points of the helical antenna 20 results in a low cost, effectively lossless, RF power amplifier-antenna arrangement, in which the relatively low power conversion efficiencies of the respective RF amplifiers 30 and 40 combine together to effectively optimize the DC power to radiated power conversion efficiency for the limited available performance of the respective amplifiers.

Figure 1:
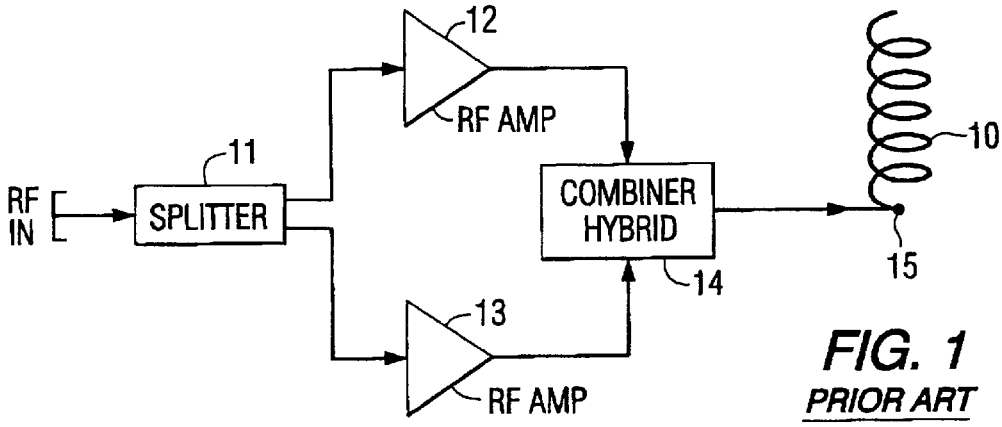
FIG. 1 PRIOR ART
FIG. 1 diagrammatically illustrates a conventional lossy hybrid circuit arrangement for feeding a single feed port of a helical antenna with a combined RF signal derived from plural RF amplifiers.
Figure 3:
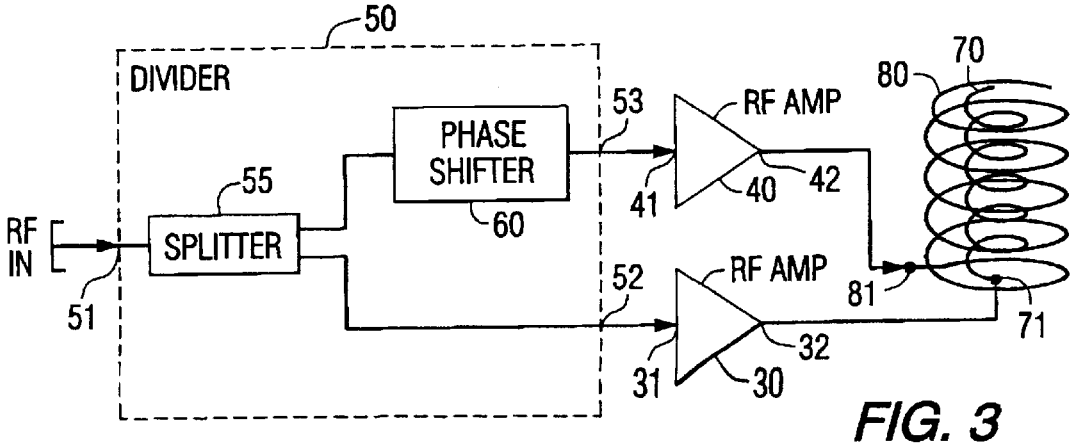
FIG. 3 diagrammatically illustrates a bifilar helical antenna, respective helical windings of which are coupled to RF power amplifiers, that are driven by phase offset versions of an input signal to be radiated by the antenna.

FIG. 3 diagrammatically illustrates a second embodiment of the invention, in which the monofilar antenna 20 of FIG. 2 is replaced by a pair of coaxial bifilar helical antenna windings 70 and 80, having respective feed locations 71 and 81, that are coupled to the outputs 32 and 42 of the RF power amplifiers 30 and 40, of the embodiment of FIG. 2. As in the monofilar embodiment of FIG. 2, feed locations 71 and 81 of coaxial antenna windings 70 and 80 are respectively driven by phase offset versions of the input signal to be radiated. As in the single winding configuration of FIG. 1, the respective antenna feed locations 71 and 81 are points on the coaxial antenna windings 70 and 80 that provide maximum signal coupling between respective input signals supplied thereto, with the physical separation between feed locations 71 and 81 having an electrical phase differential defined in accordance with the RF frequency of the driving signal.

For deriving the feed signals for the respective antenna windings 70 and 80, an RF input signal of interest is coupled to the input 51 of a signal divider (splitter and phase delay circuit) 50. As in the monofilar embodiment of FIG. 2, the first output port 52 of the signal divider 50 is coupled to input 31 of the first RF power amplifier 30, while the second output port 53 of signal divider circuit 50 couples a phase offset version of the input signal to an input 41 of the second Rf power amplifier 40. The phase differential between the signals at divider output ports 52 and 53 is derived by the phase delay circuit 60 coupled between input port 51 and output port 53, and is equal to the effective electrical phase differential between the spaced apart feed locations 71 and 81 helical antenna windings 70 and 80 at the RF frequency of interest.

As will be appreciated from the foregoing description, the previously described efficiency limitations associated with feeding a single port of a limited space deployable helical antenna with a lossy circuit configuration containing low efficiency RF power amplifiers are effectively obviated by the multi RF amplifier feed arrangement of the invention, which combines the power conversion efficiencies of low efficiency RF amplifiers in an effectively lossless manner, and feeds the outputs of such RF power amplifiers, exclusive of a lossy hybrid combiner, to respectively spaced apart, impedance matched, near end field feed locations of the helical antenna.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. An arrangement for driving a helical antenna comprising:

a first power amplifier having an input to which an input signal to be radiated is supplied, and an output coupled to a first feed location of said helical antenna; and a second power amplifier having an input to which a version of said input signal, offset in phase from the input signal applied to the input of said first power amplifier, is supplied, and an output coupled to a second feed location of said helical antenna, spaced apart from said first feed location.

2. An arrangement according to claim 1, wherein said helical antenna comprises a monofilar helical antenna.

3. An arrangement according to claim 1, wherein said helical antenna comprises a bifilar helical antenna.

4. An arrangement according to claim 1, further including a signal divider which is operative to output respective versions of a signal applied thereto, which respective versions are offset in phase with respect to one another, said signal divider having an input port to which a signal to be radiated is supplied, a first output port coupled to said input of said first power amplifier, and a second output port coupling said phase offset version of said input signal to said input of said second power amplifier.

5. An arrangement according to claim 4, wherein said signal divider is operative to output said respective versions of a signal, which are offset in phase with respect to one another by an electrical phase differential between said first and second spaced apart feed locations of said helical antenna.

6. An arrangement for optimizing the efficiency of converting DC power of RF power amplifier circuitry into power irradiated by a helical antenna comprising:

a plurality of RF amplifiers to which respectively phase-offset versions of an input signal to be amplified an irradiated by said helical antenna are supplied; and Rf signal transmission paths which feed the outputs of said plurality of RF power amplifiers to respectively spaced apart, impedance matched, near end field feed locations of said helical antenna.

7. An arrangement according to claim 6, further comprising a signal divider and a phase delay circuit coupled thereto which are operative to supply respective phase-offset versions of a signal to be radiated by the helical antenna to respective ones of said plurality of RF amplifiers, said respective phase-offset versions of said signal being offset in phase with respect to one another by the electrical phase differential between said respectively spaced apart feed locations of the helical antenna.

8. A method of driving a helical antenna comprising the steps of:

(a) coupling an input signal to be radiated to an input of a first power amplifier, said first power amplifier having an output coupled to a first feed location of said helical antenna; and (b) coupling a version of said input signal, offset in phase from the input signal applied to said input of said first power amplifier to an input of a second power amplifier, said second power amplifier having an output coupled to a second feed location of said helical antenna, that is spaced apart from said first feed location.

9. A method according to claim 8, wherein said helical antenna comprises a monofilar helical antenna.

10. A method according to claim 8, wherein said helical antenna comprises a bifilar helical antenna.

11. A method according to claim 8, further including the preliminary step (c) of coupling a signal to be radiated to a signal divider which is operative to output respective versions of said signal applied thereto that are offset in phase with respect to one another, said signal divider having a first output port coupled to said input of said first power amplifier, and a second output port coupling said phase offset version of said input signal to said input of said second power amplifier.

12. A method according to claim 11, wherein said signal divider to which said signal to be radiated is coupled in step (c) is operative to output said respective versions of said signal, which are offset in phase with respect to one another by an electrical phase differential between said first and second spaced apart feed locations of said helical antenna.

13. A method of optimizing the DC power to effective irradiated power conversion efficiency of a helical antenna comprising the steps of:

(a) providing a plurality of RF power amplifiers, having respective outputs coupled to spaced apart feed locations of said helical antenna; and (b) coupling respective phase-offset versions of an input signal to be radiated by said helical antenna to input ports of respectively different ones of said plurality of power amplifiers.

14. A method according to claim 13, wherein said helical antenna comprises a monofilar helical antenna.

15. A method according to claim 13, wherein said helical antenna comprises a bifilar helical antenna.

16. A method according to claim 13, wherein step (b) comprises coupling a signal to be radiated to a signal divider, which is operative to produce at output ports thereof said respective phase-offset versions of said signal applied thereto, said output ports being coupled to respective inputs of said power amplifiers.

17. A method according to claim 16, wherein said signal divider is operative to output said respective phase-offset versions of said signal, which are offset in phase with respect to one another by an electrical phase differential between said respective spaced apart feed locations of said helical antenna.

* * * * *